US009216451B2

(12) United States Patent
Lee et al.

(10) Patent No.: US 9,216,451 B2
(45) **Date of Patent: *Dec. 22, 2015**

(54) METHOD OF CASTING A COMPONENT HAVING INTERIOR PASSAGEWAYS

(71) Applicant: Mikro Systems, Inc., Charlottesville, VA (US)

(72) Inventors: Ching-Pang Lee, Cincinnati, OH (US); Gary B. Merrill, Orlando, FL (US); Andrew J. Burns, Longwood, FL (US)

(73) Assignees: Mikro Systems, Inc., Charlottesville, VA (US); Siemens Energy, Inc., Orlando, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/551,236

(22) Filed: Nov. 24, 2014

(65) Prior Publication Data

US 2015/0075746 A1 Mar. 19, 2015

Related U.S. Application Data

(63) Continuation of application No. 13/087,428, filed on Apr. 15, 2011, now Pat. No. 8,936,068.

(60) Provisional application No. 61/350,080, filed on Jun. 1, 2010.

(51) Int. Cl.

| | |
|---|---|
| ***B22C 7/02*** | (2006.01) |
| ***B22C 9/04*** | (2006.01) |
| ***B22C 9/10*** | (2006.01) |
| ***B22C 9/22*** | (2006.01) |
| ***B22D 17/00*** | (2006.01) |
| ***B22D 29/00*** | (2006.01) |

(52) U.S. Cl.

CPC . *B22C 9/043* (2013.01); *B22C 7/02* (2013.01); *B22C 7/026* (2013.01); *B22C 9/04* (2013.01); *B22C 9/22* (2013.01); *B22D 17/00* (2013.01); *B22D 29/00* (2013.01); *Y10T 428/12361* (2015.01)

(58) Field of Classification Search

CPC ..... B22C 7/02; B22C 7/023; B22C 7/026; B22C 9/04; B22C 9/043; B22C 9/046; B22C 9/10; B22C 9/103; B22C 9/108; B22C 9/22; B22D 29/00

USPC ..... 164/516, 34, 35, 45, 361, 369

See application file for complete search history.

(56) References Cited

U.S. PATENT DOCUMENTS 8,936,068 B2 * 1/2015 Lee et al. ..... 164/516

* cited by examiner

*Primary Examiner* — Kevin P Kerns

(74) *Attorney, Agent, or Firm* — Michael Haynes PLC; Michael N. Haynes

(57) ABSTRACT

A method of casting a component (42) having convoluted interior passageways (44). A desired three dimensional structure corresponding to a later-formed metal alloy component is formed by stacking a plurality of sheets (18, 20) of a fugitive material. The sheets contain void areas (22) corresponding to a desired interior passageway in the metal alloy component. A ceramic slurry material is cast into the three dimensional structure to form either a ceramic core (34) or a complete ceramic casting vessel (38). If just a ceramic core is formed, a wax pattern is formed around the ceramic core and an exterior ceramic shell (38) is formed around the wax pattern by a dipping process prior to the removal of the fugitive material and wax. An alloy component having the desired interior passageway is cast into the casting vessel after the fugitive material is removed.

18 Claims, 6 Drawing Sheets

METHOD OF CASTING A COMPONENT HAVING INTERIOR PASSAGEWAYS

This application is a Continuation of U.S. patent application Ser. No. 13/079,428, filed on Apr. 15, 2011, and which issued as U.S. Pat. No. 8,936,068 on 20 Jan. 2015. This application also claims benefit of the 1 Jun. 2010 filing date of U.S. Provisional Application No. 61/350,080, which is incorporated by reference herein.

FIELD OF THE INVENTION

This invention relates generally to the field of casting of materials, and more particularly, to a method of casting a component having convoluted internal passageways.

BACKGROUND OF THE INVENTION

Investment casting is one of the oldest known metal-forming processes, dating back thousands of years to when it was first used to produce detailed artwork from metals such as copper, bronze and gold. Industrial investment castings became more common in the 1940's when World War II increased the demand for precisely dimensioned parts formed of specialized metal alloys. Today, investment casting is commonly used in the aerospace and power industries to produce gas turbine components such as airfoils having complex outer surface shapes and internal cooling passage geometries.

The production of a component using the prior art lost wax investment casting process involves producing a ceramic casting vessel including an outer ceramic shell having an inside surface corresponding to the desired outer surface shape of the component, and one or more ceramic cores positioned within the outer ceramic shell corresponding to hollow interior passages to be formed within the component. Molten metal alloy is introduced into the ceramic casting vessel and is then allowed to cool and to solidify. The outer ceramic shell and ceramic core(s) are then removed by mechanical or chemical means to reveal the cast component having the desired external shape and hollow interior volume(s) in the shape of the ceramic core(s).

The known investment casting process is useful for producing components having a limited number of interior passages of relatively simple shape, such as a turbine blade design which includes relatively straight radially extending cooling passages, such as illustrated in U.S. Pat. No. 7,534,089. However, much more complex three dimensional cooling schemes incorporating convoluted 3-D cooling passages will be needed in the near future for advanced gas turbine blades, and the production and use of ceramic cores reflecting such convoluted cooling passages will surpass existing investment casting process capabilities.

Accordingly, an improved method of casting components with interior passageways is needed.

BRIEF DESCRIPTION OF THE DRAWINGS

The invention is explained in the following description in view of the drawings that show.

DETAILED DESCRIPTION OF THE INVENTION

Figure 1:
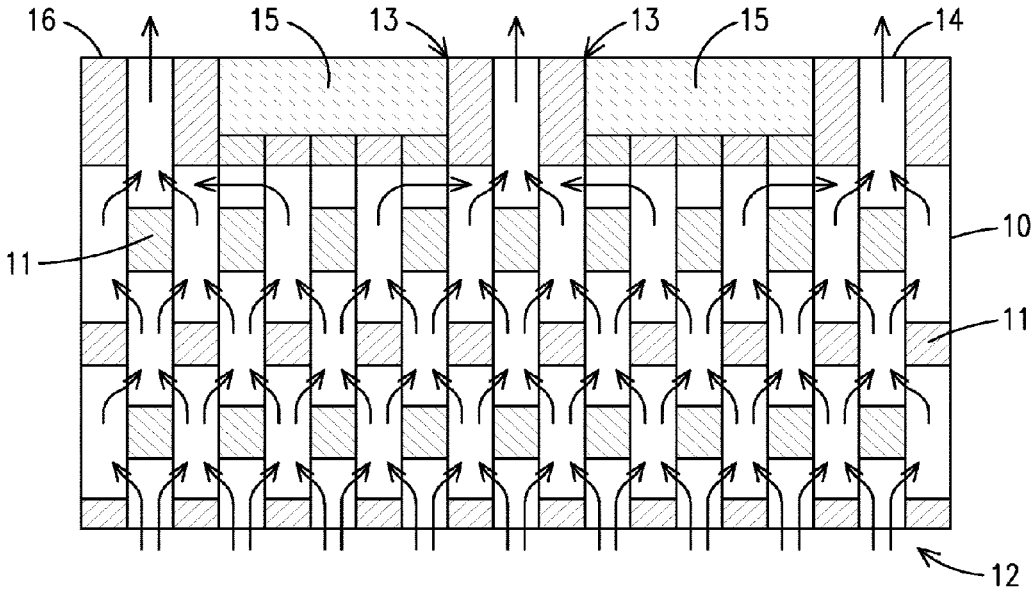
FIG. 1 is a schematic illustration of a trailing edge portion of a gas turbine airfoil illustrating a convoluted cooling air flow scheme.

FIG. 1 is a schematic illustration of a trailing edge portion of a gas turbine airfoil 10 illustrating a convoluted cooling air flow scheme 12. This illustration is a planar cross-sectional view of the airfoil, but one will appreciate that the cooling air flow paths (illustrated by arrows) may also include a third dimensional component rising above and falling below the illustrated cross section (above and below the plane of the paper or screen on which the figure is displayed) such that the cooling air progresses along a three dimensional convoluted pathway which weaves left and right as well as up and down around various structures 11 within the airfoil 10 as it moves toward the exit holes 14 formed at the trailing edge 16 of the airfoil 10. The trailing edge 16 may also be formed to include a plurality of unconnected openings 13 between respective exit holes 14, wherein the unconnected openings 13 can then be filled with a ceramic insulating material 15. Prior art ceramic core investment casting techniques would be incapable of producing such a component structure due to the convoluted geometry of the cooling passageways.

The present invention provides for the fabrication of a ceramic core appropriate for casting convoluted structures such as illustrated in FIG. 1 by utilizing a layering process which allows a three dimensional mold for the ceramic core to be constructed from a stacked plurality of layers of fugitive material. This allows the three dimensional structural detail of the mold to be devolved into a plurality of two dimensional layers, where each layer can be conveniently fabricated to include void areas in appropriate regions, such that when the layers are stacked into the desired three dimensional structure, the adjoining void areas define a desired three dimensional passageway within the three dimensional structure. The term "two dimensional" as used herein when referring to the layers of a stacked mold is meant to include a finite third dimension equivalent to the thickness of the sheet of material, where the thickness of the material is selected to be large enough for convenience in handling the sheet and thin enough to achieve a desired degree of detail in the third dimension of the stacked mold.

Figure 2:
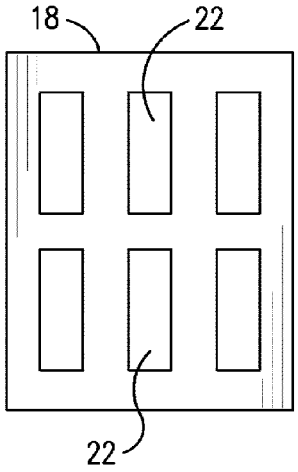
FIG. 2 is a plan view of a first laminate sheet of fugitive material.
Figure 3:
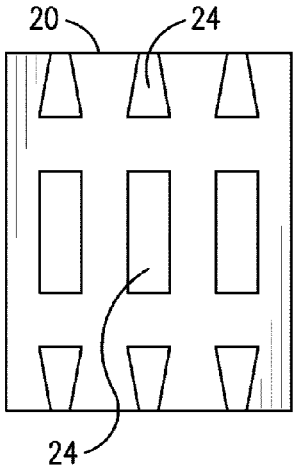
FIG. 3 is a plan view of a second laminate sheet of fugitive material.
Figure 4:
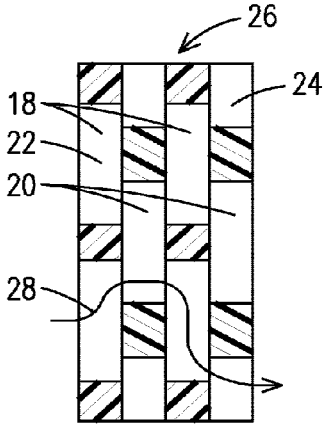
FIG. 4 is a three dimensional structure formed by stacking the sheets of FIGS. 2 and 3.

FIGS. 2 and 3 are plan views of two different designs of sheets of material 18, 20 which have somewhat different shapes of void areas 22, 24. A plurality of each sheet design may be fabricated from a fugitive material, and the sheets then stacked to form a three dimensional structure 26, such as shown in FIG. 4, such that the adjoining void areas 22, 24 define a convoluted path 28 through the three dimensional structure 26. The term "fugitive material" as used herein means a material which can function as a mold for casting a ceramic part within the three dimensional structure and which can then be removed from the ceramic cast part by dissolving, melting and/or vaporization without harming the ceramic cast part. A typical fugitive material used for this invention may be a rubber or plastic material. The material may be selected to achieve desired properties, such as thermal expansion (relative to the ceramic core material) and/or its mode of being made fugitive. The sheets of material 18, 20 may themselves be cast in a respective master mold (not shown) or they may be cut from an integral sheet of the fugitive material such as by laser cutting or water cutting. The sheets of material 18, 20 may be joined together when stacked to form the three dimensional structure by the use of an adhesive or other means.

Figure 5:
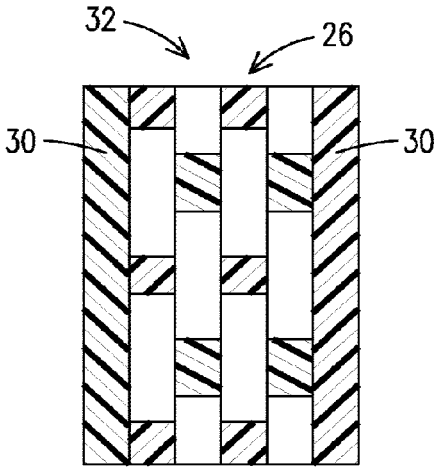
FIG. 5 is a core die incorporating the three dimensional structure of FIG. 4.
Figure 6:
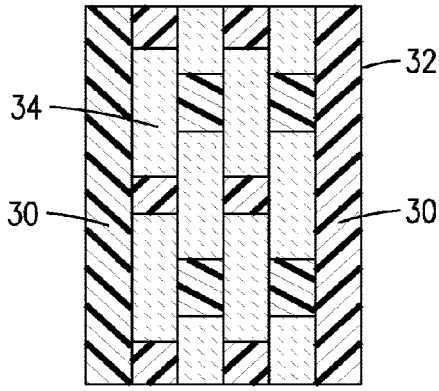
FIG. 6 is the core die of FIG. 5 being used for casting a ceramic core material.
Figure 7:
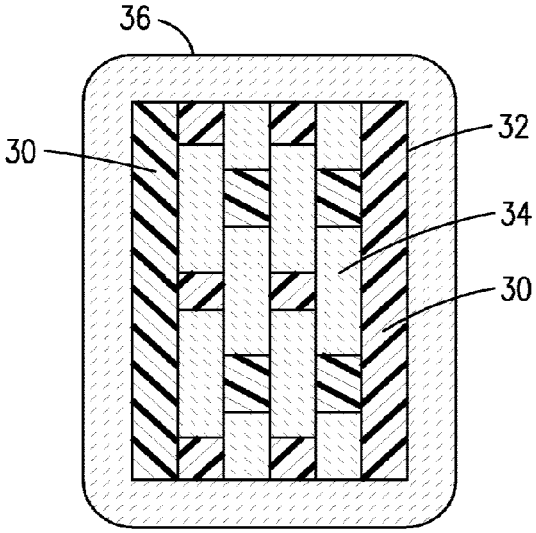
FIG. 7 is the core die and ceramic core material of FIG. 6 after being dipped in a ceramic shell material.
Figure 8:
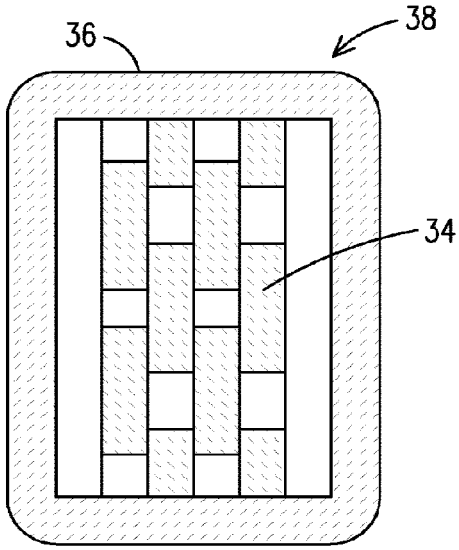
FIG. 8 is a ceramic casting vessel formed by removing the fugitive material from the structure of FIG. 7.
Figure 9:
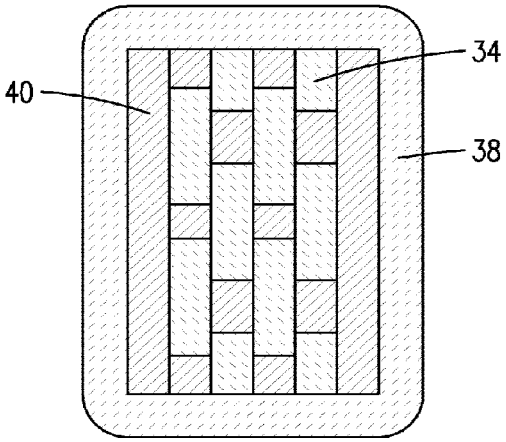
FIG. 9 is the casting vessel of FIG. 8 being used for casting a metal alloy material.
Figure 10:
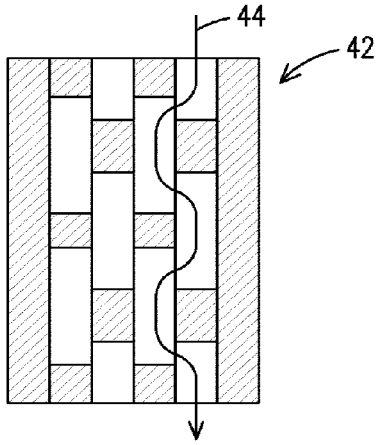
FIG. 10 is a cast metal alloy component revealed by removing the ceramic portions of the structure of FIG. 9.

The three dimensional structure 26 of FIG. 4 is sealed as appropriate such as with top and bottom sheets 30 or other structures to form a core die 32 as shown in FIG. 5. The core die 32 is capable of receiving and retaining ceramic slurry which cures to form a ceramic core 34 as shown in FIG. 6. The structure of FIG. 6 may then be surrounded by a ceramic shell 36 as shown in FIG. 7 such as by using a known dipping process while the fugitive material is still in place. The fugitive material three dimensional structure 26 is then removed, such as by heating or other processing, to reveal a ceramic casting vessel 38 including the external ceramic shell 36 and the internal cast ceramic core 34 as shown in FIG. 8. Molten alloy 40 is then cast into the ceramic casting vessel 38 as shown in FIG. 9, and after the alloy has solidified, the ceramic casting vessel 38 is removed by mechanical and/or chemical means to reveal the final cast alloy component 42 having convoluted interior passageways 44 as shown in FIG. 10.

In prior art investment casting processes for hollow parts, a ceramic casting mold is formed by positioning a ceramic core within the two joined halves of a steel mold (referred to as the wax die or wax pattern tooling) which defines an injection volume that corresponds to the desired outside shape of the part. Melted wax is then vacuum injecting into the wax die around the ceramic core. Once the wax has hardened, the wax die halves are separated and removed to reveal the ceramic core encased inside a wax pattern, with the wax pattern now corresponding to the desired outside shape of the part. The outer surface of the wax pattern is then coated with a ceramic mold material, such as by a dipping process, to form the ceramic shell around the core/wax pattern. Upon hardening of the shell and removal of the wax by melting or other means, the completed ceramic casting mold is available to receive molten steel alloy in the investment casting process. It is known that the use of wax in this manner presents a variety of difficulties and limitations in the investment casting process.

Furthermore, the dipping process typically used in the prior art and described above for forming the outer ceramic shell also presents difficulties and limitations in the investment casting process, since dipping is hard to control and requires the use of a material having different properties than those of the ceramic core material. The process of FIGS. 2-10 can be extended to eliminate the need for the wax die, wax pattern, and shell dipping by incorporating the structure of the shell into the layers of FIGS. 2-4, thereby forming the fugitive three dimensional structure to include the shell features, as described in view of FIGS. 11-20 below.

Figure 11:
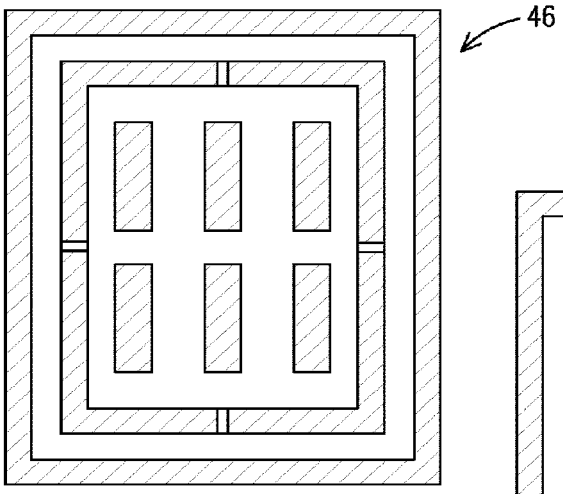
FIGS. 11-20 illustrate the steps of an alternative embodiment wherein a hollow alloy component is cast without the need for a wax mold or a ceramic dipping process.
Figure 12:
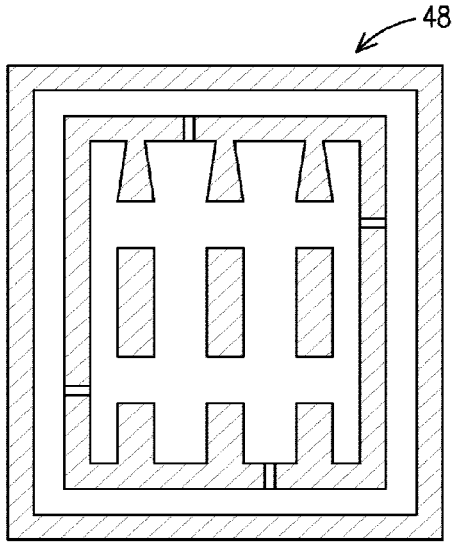
Figure 15:
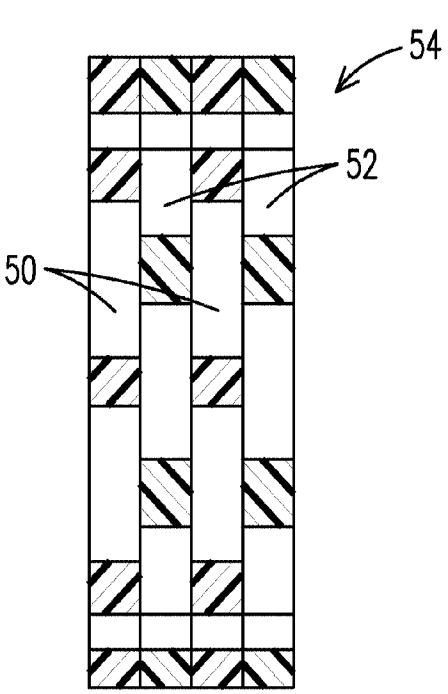
Figure 14:
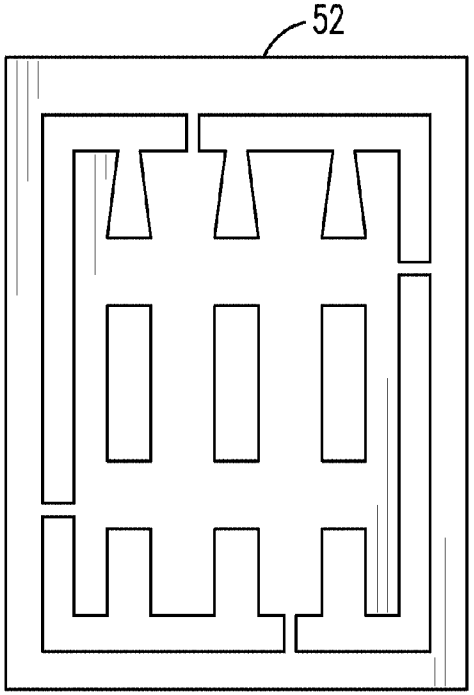
Figure 13:
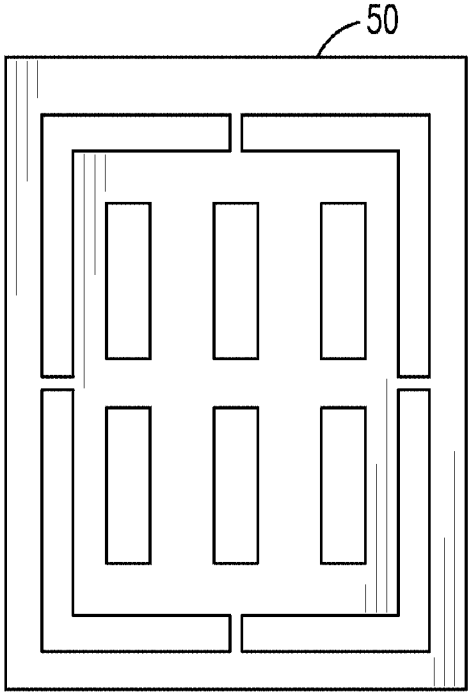
Figure 16:
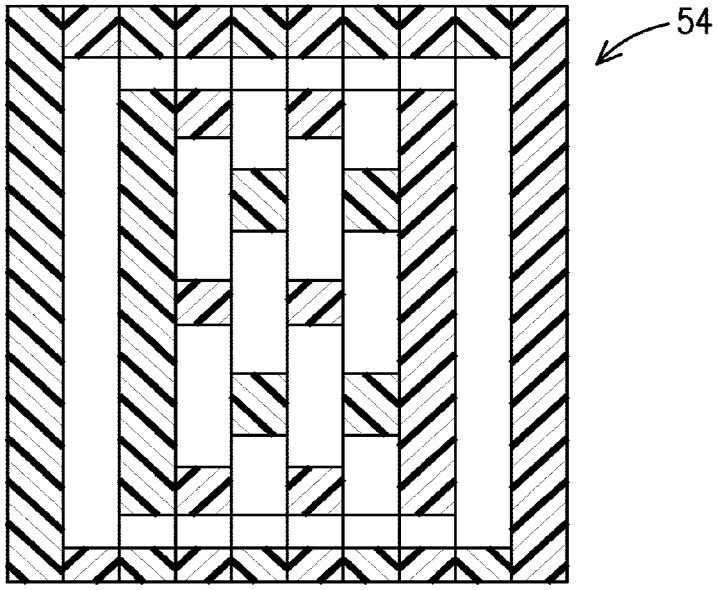
Figure 17:
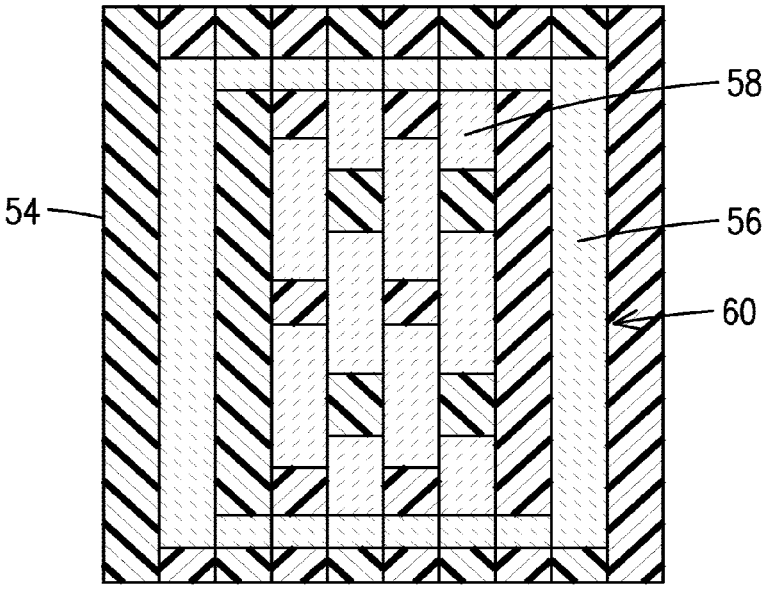
Figure 18:
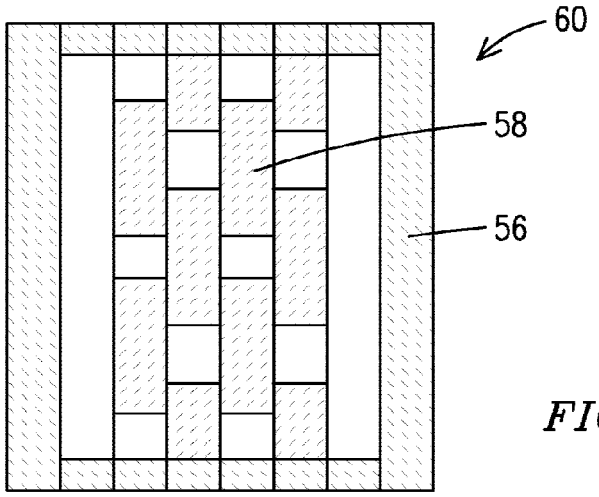
Figure 19:
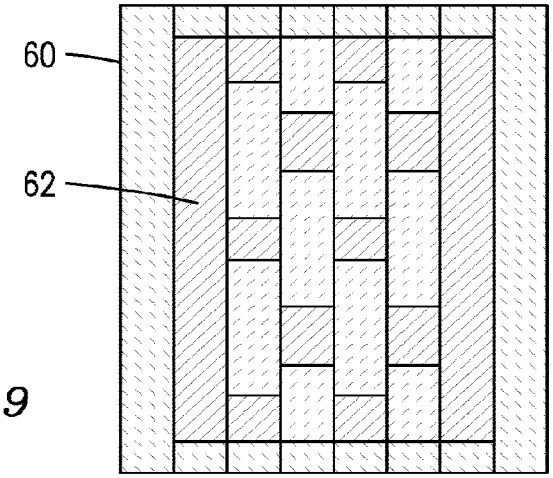
Figure 20:
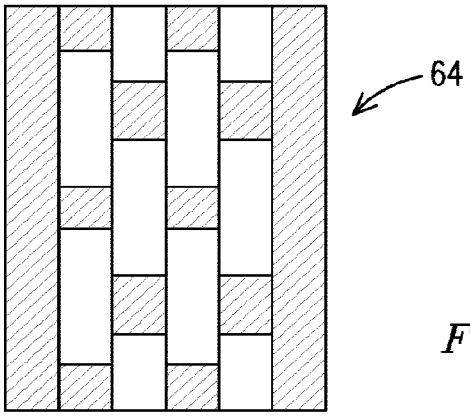

A three dimensional model is first formed of a casting vessel that may be used to cast a hollow component, and that model is devolved into a plurality of layers. If multiple products are to be produced, master tools 46, 48 may be formed for each respective layer, as illustrated in FIGS. 11 and 12. The master tools may be machined from a relatively soft metal, such as aluminum for example, or may be formed with any process that produces a desired degree of detail in the tool. Respective sheets 50, 52 of fugitive material are then cast using the master tools, as shown in FIGS. 13 and 14, and the sheets 50, 52 are stacked and bonded as necessary to form a three dimensional fugitive mold die 54, as shown in the side cross-sectional view of FIG. 15 and the top cross-sectional view of FIG. 16. A slurry of ceramic material is then cast into the fugitive mold die 54, as shown in FIG. 17, wherein the ceramic material is directed to take the shape of both the ceramic shell 56 and the interior ceramic core 58 of the ceramic casting vessel 60. The ceramic casting vessel 60 is revealed upon the removal of the fugitive material, as shown in FIG. 18. Molten alloy material 62 is then cast into the ceramic casting vessel 60, as shown in FIG. 19, and upon the alloy material solidification, the ceramic casting vessel is removed using known processes to reveal the cast hollow metal component 64 as shown in FIG. 20.

It will be appreciated that the layering process provides a degree of freedom which allows the thickness of the "two dimensional" sheets of material to be varied as desired to achieve a desired degree of fidelity in the profile of the interior cooling passages. For example, if the passageways are small and contain a large degree of curvature in a direction perpendicular to the axis of stacking of the layers of material, then each layer would be formed to be relatively thinner than for an embodiment where the passageways are larger and contain a lesser degree of curvature. The selection of the thickness of the layers can be likened to the process of digitizing an analog signal; i.e. the smaller portions of the signal are represented by each bit of digital data (thinner layers) when a high level of fidelity is desired, and relatively later portions of the signal are represented by each bit of digital data (thicker layers) when a lower level of fidelity is acceptable. The layers of material may be the same thickness throughout the three dimensional stacked structure or they may vary in thickness according to local design conditions.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What is claimed is:

1. A method of casting a component, the method comprising:

forming a plurality of sheets of fugitive material, each sheet corresponding to a respective layer of a desired three dimensional structure, at least some of the sheets each containing a respective void area in a location corresponding to a location of a first passageway within the desired three dimensional structure;

stacking the sheets to form the three dimensional structure, void areas in predetermined adjacent sheets being aligned to define the first passageway within the three dimensional structure, wherein the three dimensional structure comprises an outer perimeter defining a fugitive mold die;

injecting ceramic material slurry into the three dimensional structure and allowing the ceramic material to harden, the first passageway thus being filled with the ceramic material in a shape corresponding to the first passageway, wherein the fugitive mold die is filled with the ceramic material while forming an outer ceramic shell at the outer perimeter of the three dimensional structure, the forming of the outer ceramic shell in the fugitive mold die effective to eliminate a lost wax process in connection with the forming of the outer ceramic shell;

removing the fugitive material from the hardened ceramic material to reveal a cast ceramic component;

prior to removing the fugitive material, providing an external shell structure that substantially surrounds the three dimensional structure, the external shell structure and the cast ceramic component together forming a casting vessel for receiving molten alloy material after removal of the fugitive material;

injecting the molten alloy material into the cast ceramic component and allowing the alloy material to harden, the shape of the first passageway thereby being reproduced in the alloy material; and removing the cast ceramic component from the hardened alloy material to reveal a cast alloy component having an interior passageway.

2. The method of claim 1, further comprising:

incorporating the external shell structure into the layers of the three dimensional structure.

3. The method of claim 1, further comprising:

forming a first portion of the plurality of sheets of fugitive material to have a first thickness for a first region of the three dimensional structure; and forming a second portion of the plurality of sheets of fugitive material to have a second thickness different than the first thickness for a second region of the three dimensional structure.

4. The method of claim 1, further comprising casting the sheets of fugitive material in at least two different master molds.

5. The method of claim 1, further comprising forming the sheets of fugitive material by cutting respective voids into respective integral sheets of the fugitive material.

6. The method of claim 1, wherein:

a respective thickness of individual sheets of the plurality of sheets is selectively varied over respective regions of the three dimensional structure based on profile variation of the first passageway over the respective regions of the three dimensional structure.

7. The method of claim 1, wherein:

the first passageway is convoluted.

8. The method of claim 1, wherein:

the first passageway weaves left, right, up, and down within the three dimensional structure.

9. The method of claim 1, wherein:

a portion of the plurality of sheets defines a second passageway within the desired three dimensional structure.

10. The method of claim 1, wherein:

a portion of the plurality of sheets defines a second passageway that weaves left, right, up, and down within the three dimensional structure.

11. The method of claim 1, wherein:

a portion of the plurality of sheets defines a second passageway within the desired three dimensional structure, the second passageway interconnected with the first passageway.

12. The method of claim 1, wherein:

a portion of the plurality of sheets defines a second passageway within the desired three dimensional structure, the second passageway not interconnected with the first passageway, the second passageway configured to be filled with a ceramic material.

13. The method of claim 1, wherein:

the plurality of sheets are stacked in an alternating arrangement.

14. The method of claim 1, wherein:

the plurality of sheets are stacked in an alternating arrangement that is configured so that shapes of adjoining void areas define at least one three dimensional convoluted passage through the three dimensional structure.

15. The method of claim 1, wherein:

the plurality of sheets are stacked in an alternating arrangement that is configured so that shapes of adjoining void areas define the first passageway as a convoluted passage through the three dimensional structure.

16. The method of claim 1, wherein:

the plurality of sheets are stacked in an alternating arrangement that is configured so that shapes of adjoining void areas define a plurality of three dimensional convoluted passages through the three dimensional structure.

17. The method of claim 1, wherein:

the cast alloy component comprises a trailing edge portion of a gas turbine airfoil.

18. A method comprising:

forming a plurality of sheets of fugitive material, each sheet corresponding to a respective layer of a desired three dimensional structure, each sheet defining a respective plurality of void areas;

stacking the plurality of sheets to form the three dimensional structure, the plurality of void areas in predetermined adjacent sheets being aligned to define respective portions of a plurality of convoluted passageways within the three dimensional structure, wherein the three dimensional structure comprises an outer perimeter defining a fugitive mold die;

injecting ceramic material slurry into the three dimensional structure and allowing the ceramic material to harden, wherein the ceramic material slurry forms an outer ceramic shell at the outer perimeter of the three dimensional structure, the forming of the outer ceramic shell in the fugitive mold die effective to eliminate a lost wax process in connection with the forming of the outer ceramic shell;

removing the fugitive material from the hardened ceramic material to reveal a cast ceramic component;

prior to removing the fugitive material, providing an external shell structure that substantially surrounds the three dimensional structure, the external shell structure and the cast ceramic component together forming a casting vessel for receiving molten alloy material after removal of the fugitive material;

injecting the molten alloy material into the cast ceramic component and allowing the alloy material to harden, the shape of the plurality of convoluted passageways thereby being reproduced in the alloy material; and removing the cast ceramic component from the hardened alloy material to reveal a cast alloy component having a plurality of convoluted interior passageways.

* * * * *